United States Patent [19]

Mitchell et al.

[11] Patent Number: 4,930,900

[45] Date of Patent: Jun. 5, 1990

[54] METHOD AND APPARATUS FOR MIXING LIQUID OR DRY MATERIALS

[75] Inventors: LaDonne Mitchell, 301 N. Hutton Dr., Newton, Ill. 62448; Larry D. Yargus, 402 N. 7th, Marshall, Ill. 62441; Leon W. Volk; William A. Volk, both of Newton, Ill.

[73] Assignees: LaDonne Mitchell, Newton; Larry D. Yargus, Marshall, both of Ill.

[21] Appl. No.: 150,538

[22] Filed: Feb. 1, 1988

[51] Int. Cl.[5] ..... B01F 5/04; B01F 7/04; B01F 13/10

[52] U.S. Cl. ..... 366/168; 366/172; 366/173; 366/174; 366/177; 366/181; 366/325; 366/337

[58] Field of Search ..... 366/131, 150, 152, 154, 366/155, 167, 168, 181, 172, 171, 173, 189, 245, 325, 603, 40, 64, 66, 34, 174, 177, 337

[56] References Cited

U.S. PATENT DOCUMENTS

| | | | |
|---|---|---|---|
| 1,552,400 | 9/1925 | Aspden | 366/603 |
| 2,576,548 | 11/1951 | Tarpley et al. | 366/168 |
| 3,134,579 | 5/1964 | Booth, Sr. | 366/34 |
| 3,265,227 | 8/1966 | Vratel et al. | 366/325 |
| 3,306,589 | 2/1967 | Uden | 366/16 |
| 3,346,240 | 10/1967 | Lavelle et al. | 366/168 |
| 3,642,254 | 2/1972 | Ternes | 366/603 |
| 3,853,305 | 12/1974 | Mize | 366/66 |
| 4,272,824 | 6/1981 | Lewinger et al. | 366/141 |
| 4,358,205 | 11/1982 | Eakins | 366/150 |
| 4,746,222 | 5/1988 | Cobb et al. | 366/172 |

FOREIGN PATENT DOCUMENTS

| | | | |
|---|---|---|---|
| 2450448 | 10/1980 | France | 366/603 |
| 1090584 | 5/1984 | U.S.S.R. | 366/150 |
| 1169593 | 7/1985 | U.S.S.R. | 366/131 |
| 1087022 | 10/1967 | United Kingdom | 366/603 |

*Primary Examiner*—Harvey C. Hornsby
*Assistant Examiner*—Joseph S. Machuga
*Attorney, Agent, or Firm*—Leydig, Voit & Mayer

[57] ABSTRACT

A dry material and chemical impregnation unit for mixing the dry material and chemicals separately from a mixing and delivery system prior to delivering the mixture to a delivery unit. The impregnating unit can include a set of rotating mixing blades upon which the material, such as fertilizer and chemicals impinge. The impregnating unit also can include inclined walls upon which the dry materials or a dry and liquid material, such as the fertilizer and chemicals can impinge prior to or after passing through the mixing blades. The impregnating unit further can include a baffle upon which the dry material and chemicals impinge and pass therefrom to further inclined walls forming a restricted opening to turbulently mix the materials and chemicals, with or without the mixing blade.

16 Claims, 3 Drawing Sheets

METHOD AND APPARATUS FOR MIXING LIQUID OR DRY MATERIALS

BACKGROUND OF THE DISCLOSURE

The invention relates generally to mixing liquid or dry materials and more particularly to a method and apparatus for efficiently mixing materials, such as for impregnating fertilizer with liquid chemicals with a minimum of contamination.

In mixing fertilizer with liquid chemicals, especially bulk fertilizer, prior art systems mix the chemicals with the fertilizer prior to the load out conveyor system. Such mixing results in contamination of the bulk fertilizer mixer and all of the load out conveyor system. If it is desired to change the fertilizer and chemical mix, such as changing from corn fertilizer with corn chemicals to bean fertilizer with bean chemicals, the whole mixing and conveyor system must be decontaminated, cleaned or washed out such as by a water or chemical spray. This can present a ground water contamination problem, due to the concentration of the chemicals and can require an expensive containment system to prevent ground water runoff contamination.

It also can be desirable to mix one fertilizer with another or to mix other materials such as livestock feed or other food products in a dry or liquid and dry form. One application can be adding liquid chemicals with dry salt to be spread upon areas to melt snow or ice, such as roadways.

It therefore would be desirable to mix wet or dry materials, such as fertilizers with liquid chemicals with a minimal amount of contamination of the mixing and load out conveyor system.

SUMMARY OF THE INVENTION

The above and other disadvantages of prior art dry or liquid material mixing systems are overcome in accordance with the present invention by providing a method and apparatus for impregnating the liquid chemical after the dry bulk material is delivered from the load out conveyor system. The impregnating method and apparatus mixes the chemicals and materials, such as fertilizer in a separate impregnating unit located between the delivery end of the load out conveyor system and the material delivery unit, such as a fertilizer spreader. The impregnating unit includes a plurality of mixing blades in a feed through body wherein the chemicals are sprayed into the material, such as fertilizer and mixed to ensure that the chemicals and material are uniformly mixed before the mixture is delivered to the spreader. The impregnating unit can include a restricted exit opening to assist in uniform mixing of the material and chemicals and can include a diverting baffle onto which the material and chemicals are fed before flowing into the mixing blades. Dry or liquid and dry materials can be mixed in the impregnating unit.

DESCRIPTION OF THE PREFERRED EMBODIMENTS

Figure 1:
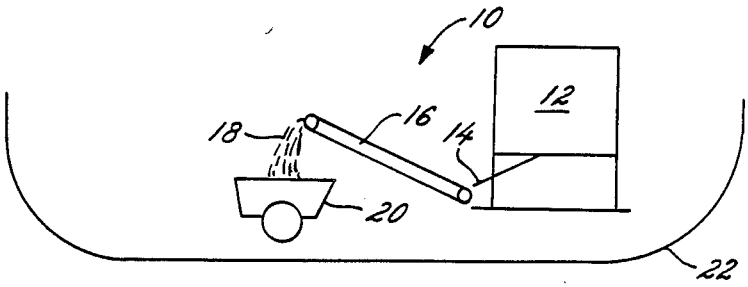
FIG. 1 (PRIOR ART)
FIG. 1 is a diagrammatic view of a prior art fertilizer and chemical mixing system.

Referring to FIG. 1, a prior art chemical and fertilizer mixing system is designated generally by the reference numeral 10. The system 10 includes a mixing unit 12, wherein bulk fertilizer is mixed and liquid chemicals are added when desired. The fertilizer(s) can be weighed or otherwise measured in the unit 12 or prior to its loading into the unit 12.

Once the chemicals and fertilizer are thoroughly and uniformly mixed in the unit 12, they are delivered, for example, by a chute 14 to a feed out conveyor system 16. Although only one conveyor is illustrated for example, the system 16 can include any number of conveyors. The conveyor system 16 feeds the mixed chemicals and fertilizer 18 into a delivery unit of some type, such as a fertilizer spreader 20.

The chemical and fertilizer mixer system 10 operates reasonably well until it is desired to change the chemical and fertilizer mixture. Since one type of chemical can contaminate a different type of chemical and fertilizer, the system 10 must be washed or otherwise decontaminated. The most common method is to spray the unit 10, the chute 14 and the conveyor system 16 with a water spray. The wash water and chemical runoff can cause a ground water contamination problem. One solution to the ground water contamination problem is to build a containment wall 22 around the system 10. The wash waster then is prevented from causing contamination of the ground water, but the wall 22 is expensive, the size and parts of the system 10 require a large volume of wash water and the complexity of the parts can lead to residual contamination problems.

Figure 2:
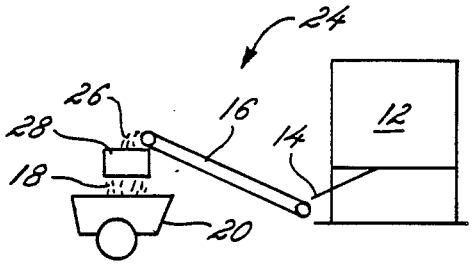
FIG. 2 is a diagrammatic view of one embodiment of the impregnating method and apparatus of the present invention.

FIG. 2 illustrates a first embodiment of an impregnating method and apparatus embodying the present invention, which is designated generally by the reference numeral 24. The impregnator 24 includes a bulk material mixing unit, which can be identical to the unit 12, such as for mixing fertilizer. The unit 12 again can include the feed chute 14, which now feeds only the mixed bulk material onto a feed out conveyor system, such as the system 16. The bulk material, such as a fertilizer 26, now is fed into an impregnating unit 28, wherein the chemicals are mixed and then the mixed chemicals and fertilizer 18 are fed into the delivery unit 20.

The impregnator 24 contaminates only the impregnating unit 28 and does not contaminate any of the other system components, such as the mixer 12, the chute 14 or the conveyor system 16. Therefore, when it is desired to change the chemical and fertilizer mixture 18, the unit 28 merely is cleaned again such as by a water spray.

However, in this case, even if the spray is to be contained in a containment wall (not illustrated) similar to the wall 22, clearly the wall will be much smaller in size and hence much less expensive. Further, the volume of waste water and chemicals is much smaller than that necessary for the system 10. Preferably, the small amount of wash water is fed directly into the chemicals and fertilizer 18 in the spreader 20 wherein it can be dispersed onto the ground being prepared as intended, which results in no undesirable contamination problems.

Figure 3:
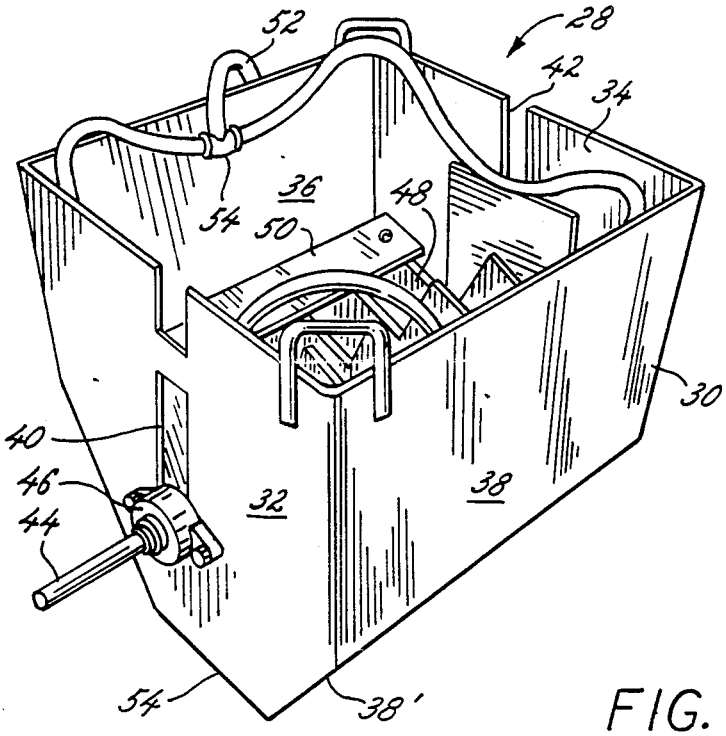
FIG. 3 is a top perspective view of one embodiment of an impregnating unit of the present invention.
Figure 4:
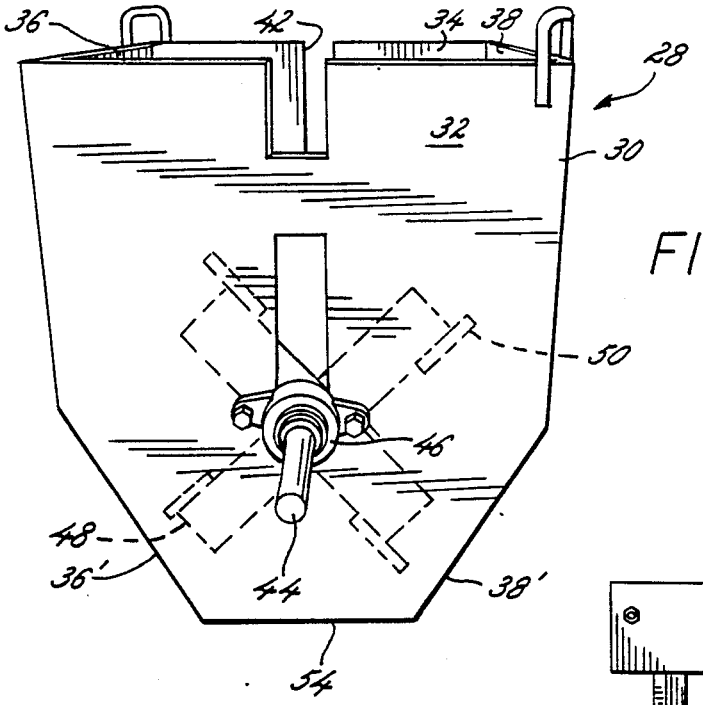
FIG. 4 is a side plan view of the impregnating unit of FIG. 3.
Figure 5:
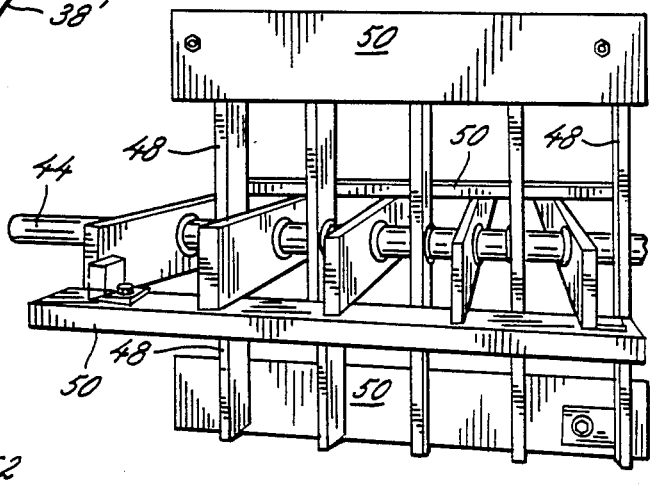
FIG. 5 is a perspective view of the mixing blades of the impregnating unit of FIG. 3.
Figure 6:
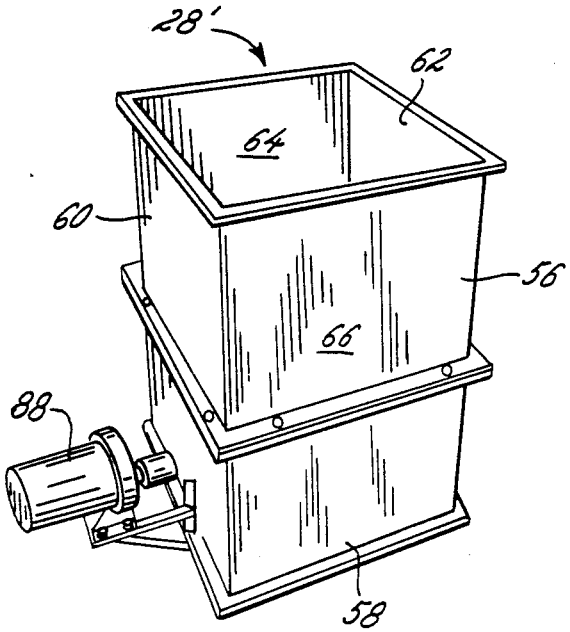
FIG. 6 is a top perspective view of a second embodiment of an impregnating unit of the present invention.
Figure 7:
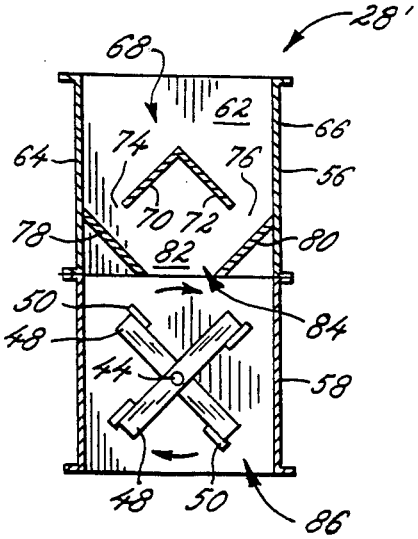
FIG. 7 is a side sectional view of the impregnating unit of FIG. 6 taken along the line 7—7 therein.
Figure 8:
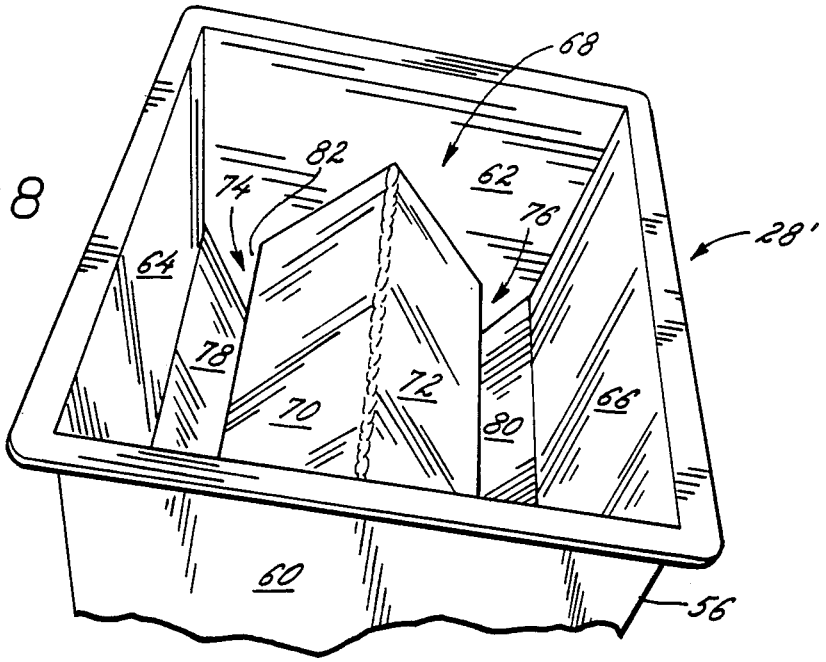
FIG. 8 is a top perspective view of one diverting baffle of the impregnating unit of FIG. 6.

One embodiment of the impregnating unit 28 is best illustrated in FIGS. 3–5. The unit 28 includes a mixing body 30 formed from a first and second pair of side walls, respectively 32, 34 and 36, 38. The first pair of side walls 32, 34 include a pair of respective slots or openings 40, 42. The slots 40, 42 include a shaft 44 rotatably mounted therein, such as by suitable bearings 46 (only one of which is illustrated).

The shaft 44 includes a plurality of sets of arms 48 fixedly mounted substantially perpendicular thereon (best illustrated in FIG. 5). Each set of arms 48 has at least one mixing blade 50 mounted at the outer ends thereof. The chemicals are added from a supply hose 52 and are sprayed into the impregnating unit 28 by one or a plurality of nozzles 54.

In operation, the material, such as the fertilizer 26, is fed into the impregnating unit 28 wherein the chemical or chemicals are sprayed onto the fertilizer 26 and the chemicals and fertilizer are mixed together to form the mixture 18. The bottom of the unit 28 includes a pair of inclined side walls 36' and 38' which are formed to provide a restricted feed outlet 54 to aid in the uniform mixing of the chemicals and fertilizer.

The unit 28 first had the shaft 44 mounted above the illustrated position, which did not provide for the most uniform mixing of the material and chemicals. The shaft 44 was then lowered to the illustrated position by extending the openings 40 into the slots illustrated. The slots 40 are thus merely illustrated to aid in the explanation of the development of the impregnator 24.

The original unit 28 also only included the arms 48, without the blades 50. This did not provide sufficiently uniform mixing and therefore the mixing blades 50 were added. Further, a second set of blades 50 (not illustrated) also were tested, but the improvement in mixing uniformity was not that significantly improved.

The shaft 44 and the mixing blades 50 are rotated on the shaft 44 by a motor (not illustrated). A speed of about 60 rpm was first tested and a doubling of the speed to 120 rpm was also tested. There did not appear to be a significant improvement in the uniform mixing of the chemicals and dry material. Therefore, although the impregnating unit 28 as illustrated operating at 60 rpm adequately mixed the chemicals and fertilizer, an improvement in uniformity and completeness of mixing was desired.

A second embodiment of the impregnating unit 28 then was designed and is best illustrated in FIGS. 6–9. The impregnating unit 28' includes an upper body portion 56 and a lower body portion 58. The upper body portion 56 includes a first and a second pair of side walls, respectively 60, 62 and 64, 66. The side walls 60 and 62 support a diverting baffle 68. The baffle 68 includes two inclined walls 70 and 72 upon which the dry material impinges and against which the chemical is sprayed by nozzles (not illustrated). The fertilizer and chemical mixture then flows past the baffle 68 and passes through a pair of side openings 74 and 76 to further impinge on four inclined side walls, three of which are illustrated, 78, 80 and 82.

The lower free edges of the side walls form a small rectangular opening 84 (such as 12 inches by 12 inches), through which the fertilizer and chemical mixture flows to the lower body 58. The lower body 58 preferably includes the rotatable shaft 44 with the arms 48 and the mixing blades 50 mounted thereon to further mix the fertilizer and chemical mixture before it exits the impregnating unit 28' via a bottom delivery opening 86. The shaft 44 is rotated by a drive motor 88, such as an electric motor, mounted on the shaft 44.

Although the most uniform mixing of the fertilizer and chemical occurs with the rotating mixing blades 50 mounted in the lower body 58, the chemical and fertilizer mixture is substantially uniformly mixed by the turbulent flow caused by the baffle 68 and the lower inclined walls 78, 80 and 82 and the one not illustrated forcing the chemical and fertilizer mixture to flow through the restricted opening 84. Thus, at least for some applications, the bottom body portion 58 can be removed or can be utilized without the rotating mixing blades 50. Two or more dry materials also can be mixed together, without a liquid material.

Figure 10:
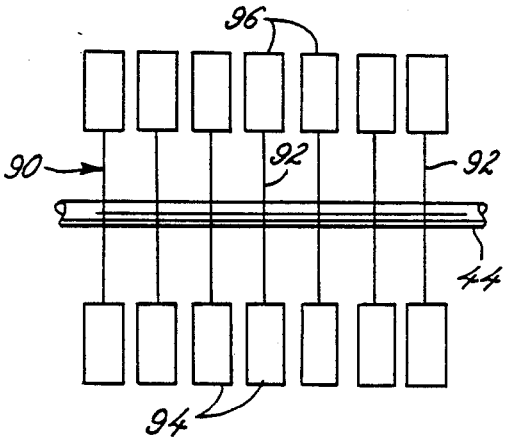
FIG. 10 is a side plan view of another embodiment of mixing blades of the present invention.
Figure 9:
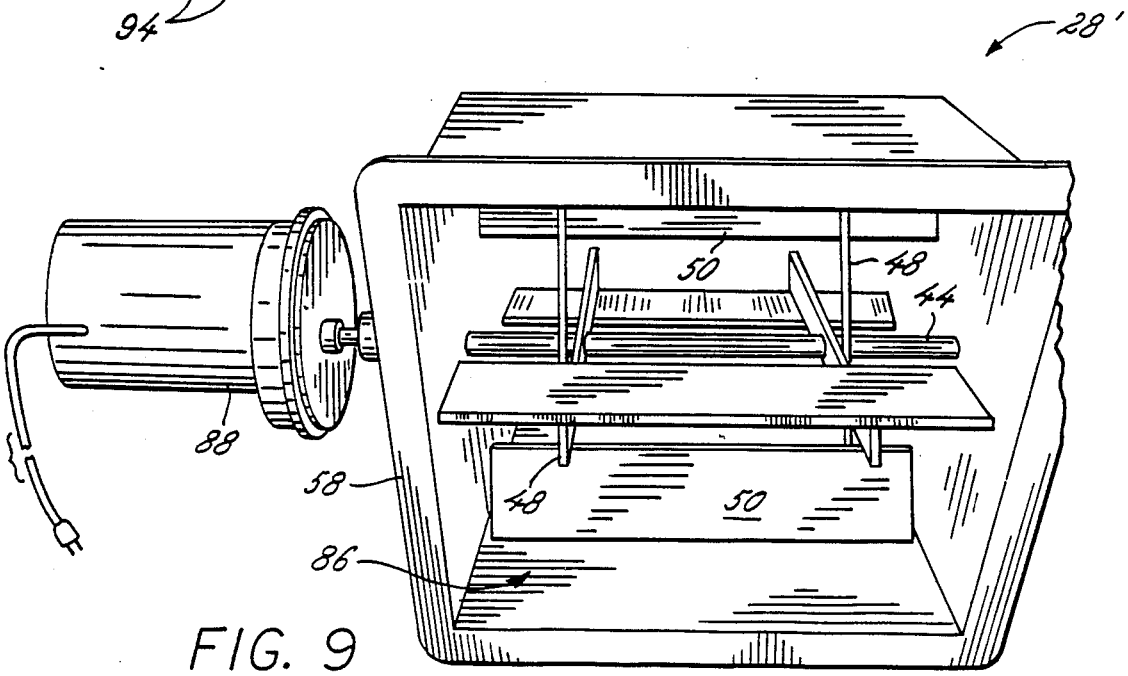
FIG. 9 is a bottom perspective view of the impregnating unit of FIG. 6 illustrating the mixing blades therein.

For units where the blades 50 are to be utilized, a further embodiment of the mixing blades is best illustrated in FIG. 10. The shaft 44 has a plurality of individual blades 90 mounted transversely on the shaft. The blades 90 are formed from a flat metal piece and include a flat center portion 92, which allows the fertilizer and chemicals to flow past them generally parallel to the plane thereof and twisted end paddle portions 94 and 96 which impinge upon the fertilizer and chemical mixture to provide the uniform mixing thereof. Although not illustrated, a second set of blades 90' can be mounted transversely to the illustrated set to further enhance the mixing action. Alternatively, each blade can be offset in angle from the adjacent blades.

Modification and variations of the present invention are possible in light of the above teachings. The nozzles, such as the nozzle 54, could be eliminated if it only is desired to mix two or more dry materials uniformly together. It is therefore to be understood that within the scope of the appended claims, the invention may be practiced otherwise than as specifically described.

What is claimed and desired to be secured by Letters Patent of the United States is:

1. A method of impregnating fertilizer with liquid chemicals in a fertilizer mixing and delivery system prior to the final fertilizer and chemical delivery unit, with a minimal amount of contamination of the system, comprising:

providing a fertilizer mixing and delivery system;

providing a fertilizer and chemical mixture delivery unit;

delivering the fertilizer to an impregnation station separate from said fertilizer mixing and delivery system and delivery unit;

mixing said fertilizer in said impregnation station with a desired liquid chemical, providing an impregnating unit having at least two inclined bottom walls and mixing said fertilizer and chemicals by impinging said mixture on said walls and providing baffle means and mixing said fertilizer and chemicals on said baffle means prior to impinging said fertilizer and chemicals on said inclined bottom walls; and delivering said mixture of fertilizer and chemicals to said delivery unit.

2. The method as defined in claim 1 including providing a set of mixing blades and mixing said fertilizer and chemicals together by impinging said fertilizer and chemicals on said blades while rotating said blades.

3. The method as defined in claim 1 including providing a second pair of inclined bottom walls with said two inclined bottom walls and forming a restricted delivery opening between said four bottom walls.

4. The method as defined in claim 3 including providing a set of mixing blades and mixing said fertilizer and chemicals together by impinging said fertilizer and chemicals on said blades while rotating said blades after passing through said delivery opening.

5. An apparatus for impregnating fertilizer with liquid chemicals in a fertilizer mixing and delivery system prior to the final fertilizer and chemical delivery unit, with a minimal amount of contamination of the system, comprising:

a fertilizer mixing and delivery system;

a fertilizer and chemical mixture delivery unit;

an impregnation station and means for delivering the fertilizer to said impregnation system separate from said fertilizer mixing and delivery system and said delivery unit;

means for mixing said fertilizer in said impregnation station with a desired liquid chemical including an impregnating unit having at least two inclined bottom walls and said means for mixing said fertilizer and chemicals include impinging said mixture on said walls and including baffle means and said means for mixing said fertilizer and chemicals include impinging said fertilizer and chemicals on said baffle means prior to impinging said fertilizer and chemicals on said inclined bottom walls; and means for delivering said mixture of fertilizer and chemicals to said delivery unit.

6. The apparatus as defined in claim 5 including a set of mixing blades and said means for mixing said fertilizer and chemicals together include impinging said fertilizer and chemicals on said blades while rotating said blades.

7. The apparatus as defined in claim 5 including a second pair of inclined bottom walls with said two inclined bottom walls forming a restricted delivery opening between said four bottom walls.

8. The apparatus as defined in claim 7 including a set of mixing blades and said means for mixing said fertilizer and chemicals together include impinging said fertilizer and chemicals on said blades while rotating said blades after passing through said delivery opening.

9. A method of mixing dry or liquid and dry materials in a mixing and delivery system prior to the final delivery unit, with a minimal amount of contamination of the system, comprising:

providing a material mixing and delivery system;

providing a material mixture delivery unit;

delivering the material to an impregnation station separate from said mixing and delivery system and said delivery unit;

mixing said material in said impregnation station with at least one other desired material, including providing an impregnating unit having at least two inclined bottom walls and mixing said materials by impinging said mixture on said walls and including providing baffle means and mixing said materials on said baffle means prior to impinging said materials on said inclined bottom walls; and delivering said material mixture to said delivery unit.

10. The method as defined in claim 9 including providing a set of mixing blades and mixing said materials together by impinging said materials on said blades while rotating said blades.

11. The method as defined in claim 9 including providing a second pair of inclined bottom walls with said two inclined bottom walls and forming a restricted delivery opening between said four bottom walls.

12. The method as defined in claim 11 including providing a set of mixing blades and mixing said materials together by impinging said materials on said blades while rotating said blades after passing through said delivery opening.

13. An apparatus for mixing dry and liquid materials in a mixing and delivery system prior to the final delivery unit, with a minimal amount of contamination of the system, comprising:

a material mixing and delivery system;

a material mixture delivery unit;

an impregnation station and means for delivering a first material to said impregnation system separate from said mixing and delivery system and said delivery unit;

means for mixing said first material in said impregnation station with a desired second material including an impregnating unit having at least two inclined bottom walls and said means for mixing said materials include impinging said mixture on said walls and including baffle means and said means for mixing said materials include impinging said materials on said baffle means prior to impinging said fertilizer and chemicals on said inclined bottom walls; and means for delivering said material mixture to said delivery unit.

14. The apparatus as defined in claim 13 including a set of mixing blades and said means for mixing said materials together include impinging said materials on said blades while rotating said blades.

15. The apparatus as defined in claim 13 including a second pair of inclined bottom walls with said two inclined bottom walls forming a restricted delivery opening between said four bottom walls.

16. The apparatus as defined in claim 15 including a set of mixing blades and said means for mixing said materials together include impinging said materials on said blades while rotating said blades after passing through said delivery opening.

* * * * *